United States Patent [19]

Bhagat

[11] 3,997,259

[45] Dec. 14, 1976

[54] APPARATUS FOR REDUCING IMAGE BACKGROUND IN ELECTROSTATIC REPRODUCTION MACHINES

[75] Inventor: Gopal C. Bhagat, Rochester, N.Y.

[73] Assignee: Xerox Corporation, Stamford, Conn.

[22] Filed: Nov. 8, 1973

[21] Appl. No.: 414,016

[52] U.S. Cl. ..... 355/3 R; 96/1 C

[51] Int. Cl.[2] ..... G03G 15/22

[58] Field of Search ..... 355/3 R, 3 DD, 17, 3; 96/1 R, 1 C; 117/17.5

[56] References Cited

UNITED STATES PATENTS

| | | | |
|---|---|---|---|
| 3,535,036 | 10/1970 | Starkweather | 355/11 |
| 3,615,395 | 10/1971 | Yamaji et al. | 96/1 R X |
| 3,730,709 | 5/1973 | Kinoshita et al. | 96/1.4 |
| 3,809,472 | 5/1974 | Liechty | 355/3 R |

*Primary Examiner*—L. T. Hix
*Assistant Examiner*—John M. Horan

[57] ABSTRACT

To enhance copy quality in an electrostatic type copier or reproduction machine, the photoconductive surface bearing the latent electrostatic image of the original being copied is, before development, exposed to a second charge generating device producing a relatively low charge opposite in polarity to the original charge. The aforesaid second charge is desirably equal to or less than the image background voltage, and serves to reduce overall image charge and thereby neutralize to a large extent the image background voltage without changing or upsetting the image voltage contrast. A low emission scorotron positioned between imaging and developing stations may serve as the second charge generating device.

5 Claims, 3 Drawing Figures

APPARATUS FOR REDUCING IMAGE BACKGROUND IN ELECTROSTATIC REPRODUCTION MACHINES

This invention relates to a reproduction machine and more particularly to a reproduction machine incorporating means to suppress background voltage without affecting image voltage contrast.

In electrostatic reproduction machines or copiers, undesirable image background often presents a problem. In this, the machine photoconductor, which has been previously uniformly charged in preparation for imaging, is exposed to a light reflection of the original being copied, such exposure creating an electrostatic latent image of the original on the photoconductor surface. In this process of reproduction, areas of the photoconductor corresponding to the document background areas, which are normally white, are fully exposed with the result that a substantial portion of the original photoconductor charge in these areas is dissipated, leaving a relatively low voltage charge. However, this charge, although relatively low, may nevertheless attract developing toner, with the result that some development of these background areas, albeit small, may nevertheless take place. As a result, objetionable background coloring or shading may take place, which is perhaps best envisioned as the grey or off-white color sometimes found on copies.

It is a principle object therefore of the present invention to provide a new and improved electrostatic reproduction apparatus and method.

It is a further object of the present invention to provide an improved arrangement for reducing image background without adverse effect on image contrast.

It is an object of the present invention to provide apparatus and method to at least in part reduce voltage in the non-image areas of the latent electrostatic image without damaging image contrast.

It is an object of the present invention to provide a method of improving image quality.

It is an object of the present invention to provide an improved image quality control for electrostatic type copiers designed to subject the electrostatic latent image on the copier photoconductive member to a second, relatively low level dissipating charge of opposite polarity to reduce voltage background.

This invention relates to an electrostatic reproduction machine comprising, in combination, a photoconductive member, first charging means to charge the photoconductive member in preparation for imaging, means to expose the charged photoconductive member to form a latent electrostatic image on the photoconductive member, and second charging means to uniformly reduce the charge on the photoconductive member following exposure, the second charging means providing a charge of opposite polarity to the original charge to reduce image background without adversely affecting image contrast.

The invention further relates to the method of reducing background during the operation of an electrostatic printing machine in the making of copies or originals, the steps which consist of, charging the photoconductive member in preparation for imaging, selectively discharging the charged photoconductive member in image configuration to produce a latent electrostatic image of the original being reproduced, and then, before developing the image, exposing the photoconductive member to a second charge of opposite polarity from the first charge to reduce image background voltage without diminishing image voltage contrast.

Other objects and advantages will be apparent from the ensuing description and drawings, in which.

Figure 1:
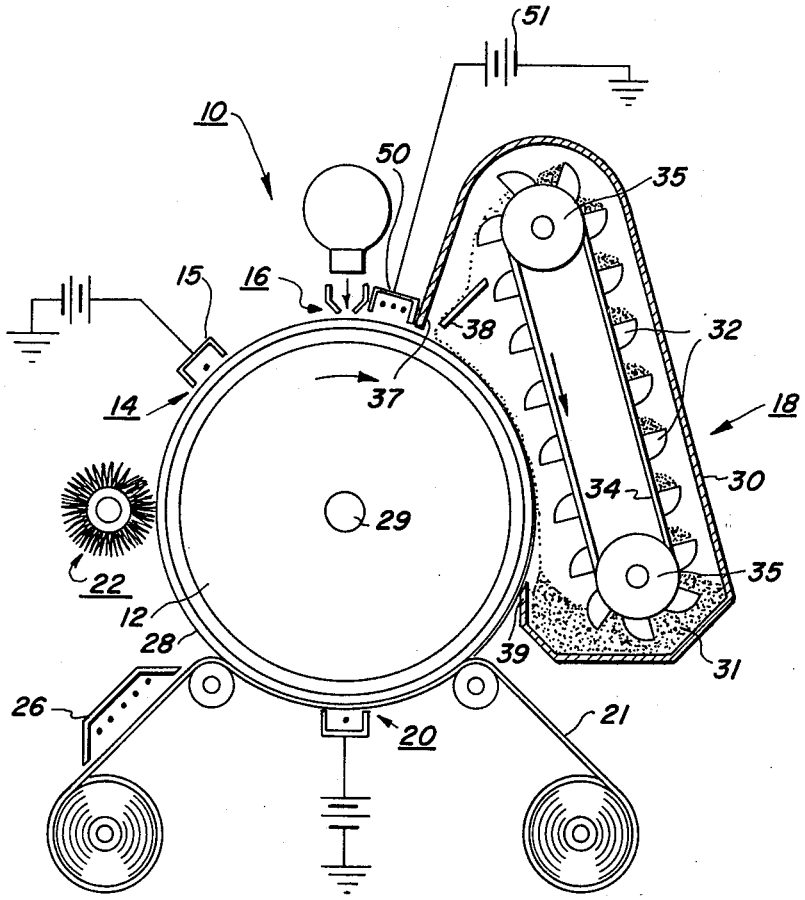
FIG. 1 is a diagramatic view in cross section of an exemplary xerographic machine embodying the principles of the present invention.

Referring to FIG. 1 of the drawings, there is shown an exemplary xerographic machine, designated generally by the numeral 10, embodying the principles of the present invention. Referring thereto, a series of processing stations are provided about the periphery of xerographic drum 12 as follows:

A charging station 14, at which a uniform electrostatic charge is deposited on the photoconductive layer of the xerographic drum 12 by a suitable corona generating means, such as corotron 15;

An exposure station 16, at which the light or radiation pattern of copy to be reproduced is projected onto the photoconductive surface of drum 12 to selectively dissipate, in accordance with the copy image pattern, the charge on the drum surface to thereby form a latent electrostatic image of the copy to be reproduced;

A development station 18, at which a xerographic developing material including toner powder having an electrostatic charge opposite to that of the latent electrostatic image on the photoconductive surface of drum 12 is brought into contact with the drum surface, the toner powder adhering to the latent electrostatic image to form a xerographic powdered image in the configuration of the copy being reproduced;

A transfer station 20, at which the xerographic powdered image is electrostatically transferred from the drum surface to a suitable support surface such as web 21; and A drum cleaning station 22 at which the surface of drum 12 is brushed to remove residual toner particles remaining thereon after image transfer.

A suitable fixing device or fuser 26 is provided to permanently fix the toner image on web 21.

The aforesaid stations are operatively disposed about the xerographic surface 12 of drum 10 upon which the images are to be formed. The photoconductive or xerographic surface 28 of drum 12 may comprise any suitable photoconductive material such as selenium. Shaft 29 of drum 12 is suitably supported for rotational movement, suitable drive means (not shown) being provided to turn drum 12 in the direction indicated by the solid line arrow as well as for initiating the cycle of operation for the various processing stations described heretofore. While the photoconductive surface for the xerographic machine 10 has been illustrated as a drum, it will be understood that other types of surface such as a belt, may instead be used.

The developing instrumentalities of development station 18 are encased in a general developer housing 30. The lower or sump portion 31 of the developer housing 30 is adapted to be filled with a quantity of two component developer material. The developer may be raised to an elevated position for cascading down the xerographic surface by a series of buckets 32 movable on a belt 34 and guided for its motion by rollers 35. Power may be imparted to the rollers by any conventional power source, not shown, to move the buckets in the direction as indicated by the arrows.

As the buckets reach their uppermost position, they are adapted to drop the developer through a pair of plates 37, 38 for guiding the developer onto the surface 28 of drum 12. Sump 31, buckets 32, and plates 37, 38 extend a width approximately equal to the width of drum 12 to insure the cascading of developer across the entire width of the photoconductive surface 28. As the developer cascades down the arc of the drum, the latent electrostatic image therebelow on the drum surface 28 is developed. As the developer material falls past the horizontal center line of drum 12, the effect of gravity drops unused developer material onto the pick off baffle 39 and back into the sump 31 for recycling. A toner dispenser (not shown) may be provided with developer housing 30 for supplementing the toner given up by the system through development of images.

In operation, the photoconductive surface 28 of drum 12 is normally charged to a predetermined positive level by corotron 15 following which the charged photoconductive surface is exposed at exposure station 16 to a light reflected image of the original being copied. Such exposure results in selective discharge of the photoconductive surface 28 in conformance with the image presented by the original on the photoconductive surface as described earlier. The photoconductive surface, bearing the latent electrostatic image, is thereafter developed at development station 18. The development material, which in the present example would use negative toner, is electrostatically attracted to and held on the photoconductive surfaces 28 by the positive charges thereon, the intensity of such charges being in accordance with and in proportion to the image outline. The developed image is thereafter transferred to web 21 following which the image on web 21 is fixed by fuser 26 to render the image permanent.

Figure 2:
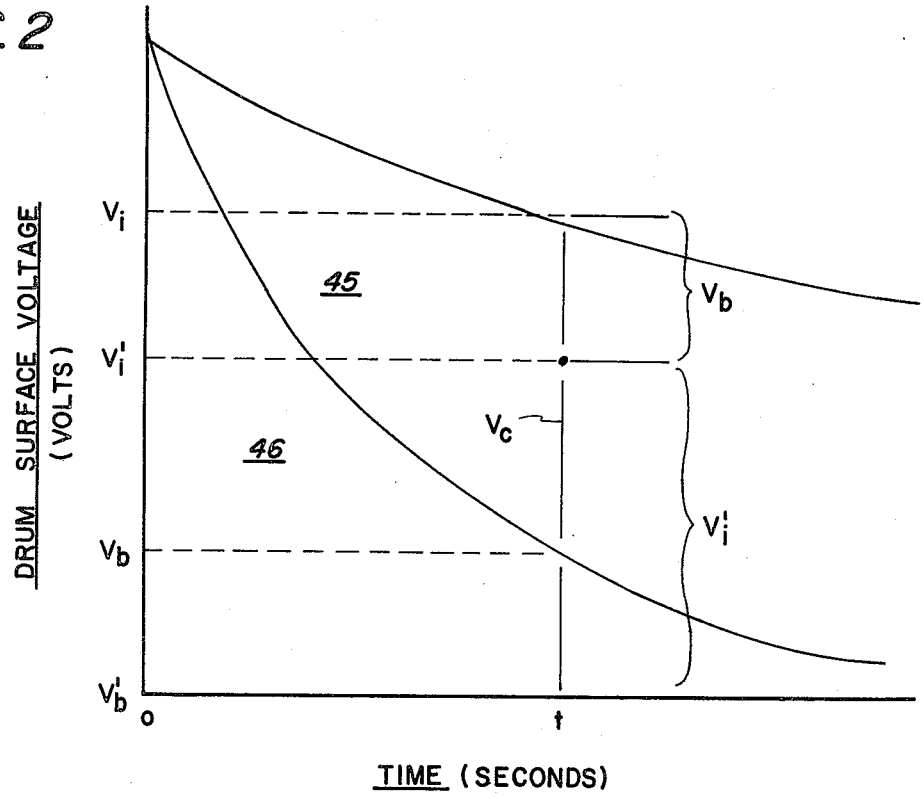
FIG. 2 is a graph plotting exposure time versus charge voltage.
Figure 3:
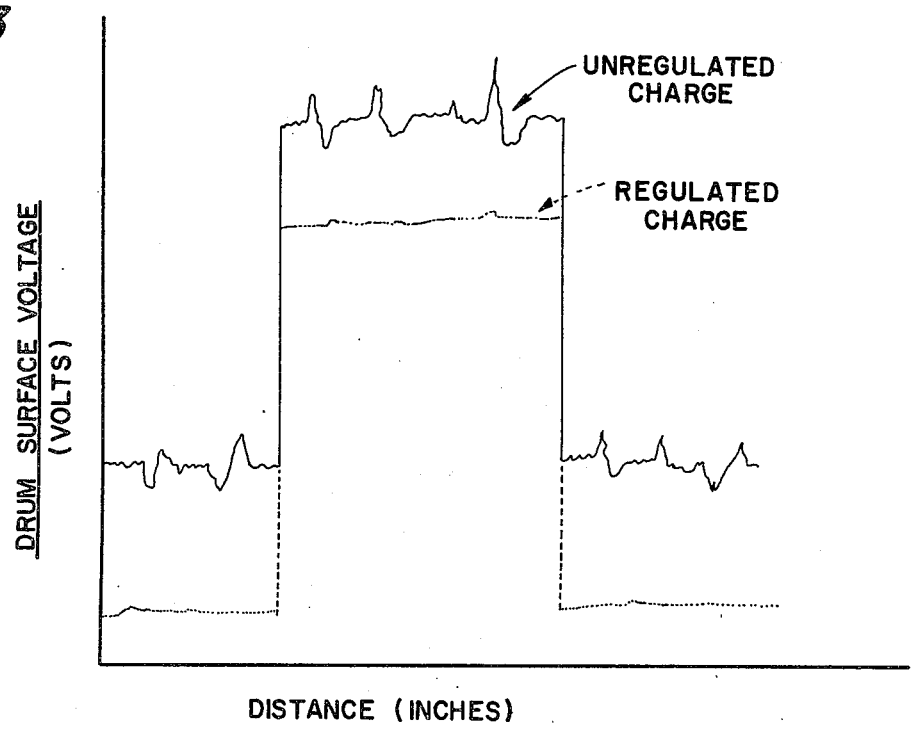
FIG. 3 is a graph comparing unregulated charge levels across a section of an electrostatic latent image with regulated charge levels of the present invention across the same image section.

Referring now to the graphs of FIGS. 2 and 3, at any exposure time t, the photoconductive surface 28 of drum 12 has a positive potential corresponding to image area 45 and background area 46. The electrostatic contrast at time $t$ may be determined by the following equation:

1. $V_i - V_b = V_c$, in which $V_i$ is the image voltage, $V_b$ is the background voltage, and $V_c$ is the voltage contrast.

If the latent electrostatic image on the photoconductive surface 28 of drum 12 is exposed to a second charge $V_2$ of polarity opposite to and substantially equal to the background voltage $V_b$, the net result, in the theoretical sense, is that the background voltage $V_b$ is reduced to zero while the image voltage $V_i$ is reduced by an amount equal to the background voltage $V_b$. This may be seen from the following equations:

2. $V_i - V_2 = V_i'$

3. $V_b - V_2 = V_b'$:

where $V_b'$ designates the new background voltage following the second charge, $V_i'$ designates the new image voltage following the second charge, and $V_2$ designates the second charge voltage.

However, the voltage contrast $V_c$ remains substantially the same as before, as may be seen from the following formula:

4. $(V_i - V_2) - (V_b - V_2) = V_i' - V_b' = V_c$

Thus, it can be seen that the voltage contrast $V_c$ which is important in providing a clear and highly contrasted reproduction or copy, remains unchanged despite exposure of the latent electrostatic image to a subsequent charge while the background voltage, representing areas whose development is undesired, is reduced to substantially zero.

To effectuate the above, a second charge unit, preferably scorotron 50, is provided on the downstream side of exposure station 16 and before development station 18. Scorotron 50 is powered from a suitable voltage source 51 to produce a negative charge on te photoconductive surface 28 which is preferably equal to or less than the background voltage $V_b$. Current through scorotron 50 is preferably kept low, a current range on the order of −1.5 micro-amps to −12.0 microamps having been found suitable.

EXAMPLE

Corotron 15 is set to charge the photoconductive surface 28 of drum 12 to approximately 1,000 volts positive. Subsequent exposure at exposure station 16 results in selective discharge of the charged surface corresponding to the image pattern of the original being copied, as explained heretofore. In this example, maximum voltage $V_i$ in the image areas is presumed to be 1,000 volts positive, representing no discharge while the voltage $V_b$ in the non-image or background areas is presumed to be 200 volts positive, representing full discharge. Using equation 1 above, the voltage contrast $V_c$ is $V_i - V_b = 1{,}000 - 200$, or 800 volts positive.

In this example scorotron 50 is set to provide a charge of 200 volts negative on the photoconductive surface 28, i.e. a charge substantially equal to and opposite in polarity from the background voltage $V_b$ of 200 volts positive. As a result, following exposure to corotron 50, the positive image voltage $V_i$ is decreased. Using equation No. 2, $V_i$ becomes 1,000 − 200 or 800 volts positive.

At the same time, background voltage $V_b$ is decreased to zero as per equation No. 3, 200 − 200 or 0. The electrostatic contrast from equation 4 however remains the same as before, i.e. 800 $(V_i')$ − 0 $(V_b')$ or 800 volts positive.

While the invention has been described with reference to the structure disclosed, it is not confined to the details set forth, but is intended to cover such modifications or changes as may come within the scope of the following claims.

What is claimed is:

1. In an electrostatic reproduction machine, the combination of: a bare photoconductive member, first charging means to place an electrostatic charge on the surface of said photoconductive member in preparation for imaging, exposure means independent of any charging means spaced downstream of the first charging means to expose without recharging said charged photoconductive member to an original being reproduced and thereby change charges on the surface of the charged member to form a latent electrostatic image of the original on the surface of said photoconductive member, and, second charging means spaced downstream of said exposure means to uniformly expose the surface of said photoconductive member to a charge opposite in polarity to the charge produced by said first charging means to thereby uniformly reduce charges remaining on the surface of said photoconductive member following exposure by said exposure means and reduce image background without adversely affecting image contrast.

2. The reproduction machine according to claim 1 in which said second charging means comprises a scorotron.

3. The reproduction machine according to claim 1 in which said second charging means charges the surface of said photoconductive member to a voltage substantially equal to the voltage of said image background.

4. A dual corotron charge and developing system for electrostatic reproduction machines of the type employing an uncoated photoconductive member on the surface of which latent electrostatic images of originals being copied are generated, the combination of a first charge corotron for charging the surface of said photoconductive member to a relatively high voltage of predetermined polarity in preparation for imaging, exposure means separate from and downstream of said first corotron adapted only to expose the charged surface of said photoconductive member to the original being copied and thereby discharge the surface of said photoconductive member in a pattern corresponding to said original, a second charge corotron separate from and downstream of said exposure means for again charging the surface of said photoconductive member to a relatively low voltage charge opposite in polarity to that of the original charge produced by said first corotron on the surface of said photoconductive member to reduce image charge background levels prior to development, the charge produced by said second corotron being substantially less than the charge produced by said first corotron, and means downstream of said second corotron to develop the charge modified image.

5. The system according to claim 4 wherein the level of said second corotron charge is substantially equal to said image background charge.

* * * * *